United States Patent [19]

Akerman

[11] 3,947,910

[45] Apr. 6, 1976

[54] AUTOMATIC HAIR BRUSH

[76] Inventor: Jean Akerman, 49 rue Richet, 75009 Paris, France

[22] Filed: Dec. 21, 1973

[21] Appl. No.: 427,061

[30] Foreign Application Priority Data

Dec. 29, 1972 France ..... 72.46851
Mar. 21, 1973 France ..... 73.10174

[52] U.S. Cl. ..... 15/27; 15/26; 132/34 R
[51] Int. Cl. ..... A46b 13/00
[58] Field of Search ..... 15/23, 24, 26, 27, 25, 15/164, 211, 213; 132/34 R, 122

[56] References Cited

UNITED STATES PATENTS

| | | | |
|---|---|---|---|
| 1,820,498 | 8/1931 | Rowley | 132/34 R |
| 2,267,031 | 12/1941 | Jefferson | 132/34 R |
| 2,636,393 | 4/1953 | Josephs | 15/26 |
| 2,764,985 | 10/1956 | Papish | 132/34 R |

*Primary Examiner*—Edward L. Roberts
*Attorney, Agent, or Firm*—Weiser, Stapler & Spivak

[57] ABSTRACT

A brush having a handle, and a head with a rotatable axle bearing radially extending bristles. Pulling of the brush by its handle in one direction along a hank of hair causes energy to be stored which is then released, causing the brush head to reverse direction of rotation and roll the hair up under tension.

11 Claims, 6 Drawing Figures

AUTOMATIC HAIR BRUSH

The invention relates to an automatic brush for hair styling and particularly for the hairdressing procedure called "brushing".

A hairbrushing procedure called brushing is known in which a hair drying technique makes it possible to produce a particular hair style, for men or women with medium length hair. In this procedure, it is known to use the combined action of a hand dryer, and of a hand brush which has bristles extending from a central axis of rotation, thus providing an essentially cylindrical brush. This technique makes possible the achievement of a smooth or puffed shape, generally referred to as "page boy". To practice this procedure, the operator first does some preliminary drying, using a hand dryer, and then rolls the hair up, one hank at a time using the cylindrical brush and dividing the hair into hanks of the diameter and length of the brush. The operator then proceeds with drying, by directing the flow of the hand dryer upon the hank rolled up on the brush until it reaches a half-dry state, and then makes the brush slide by imparting to it a manual rotational movement about its axis which locks the rolled-up hank of hair and places it under tension in the existing shape.

Experience has shown that manual operation of the brush produces fatigue of the wrist and of the fingers, accumulating from repeated rolling and unrolling of the brush around its axis of rotation.

This fatigue mounts rapidly because this type of styling takes about 20 to 45 minutes and, during that time, the wrist is displaced by an angle of about 45° relative to the axis of the arm.

The strain of the wrist movement, after a more or less extended period of work, gives rise, during the rolling and unrolling movements, to jerky motions which are prejudicial to the regularity with which tension is applied to the hank, leading to a loosening of the roll.

Finally, the time consumed by needlessly performing too many movements reduces the profitability of rendering this service.

Accordingly, an object of the present invention is to remedy these defects by providing a brush whose rolling and unrolling movements are not attributable to corresponding movements of wrists or fingers.

Another object is to provide a brush which eliminates jerky motions in the rolling and unrolling movements and which assures constant maintenance of tension on the hank.

Still another object is to provide a brush whose operation is simple and easy, reducing the time customarily associated with styling, and capable of functioning automatically or by manual operation.

These, and other objects which will appear, are achieved by means of an automatic brush for hair styling comprising a head in the shape of a cylinder of revolution about a rotational axle. The brush is further characterized in that the axle of its head is rotatably supported inside the operating handle in such manner that said head begins to rotate when it is in contact with a hank of hair and displaced by a pulling movement along that hank. A spring, disposed between handle and axle, accumulates energy through the tension produced by said rotation so that, when the manual pulling movement is discontinued, the direction of rotation of the brush head reverses. This produces an automatic rolling-up on the brush of the hank, under tension.

For further details, reference is made to the following description, in the light of the accompanying drawings, wherein FIG. 1 is a simplified diagram of a longitudinal section through the brush;

The same reference numerals denote similar elements in the various figures.

Figure 1:
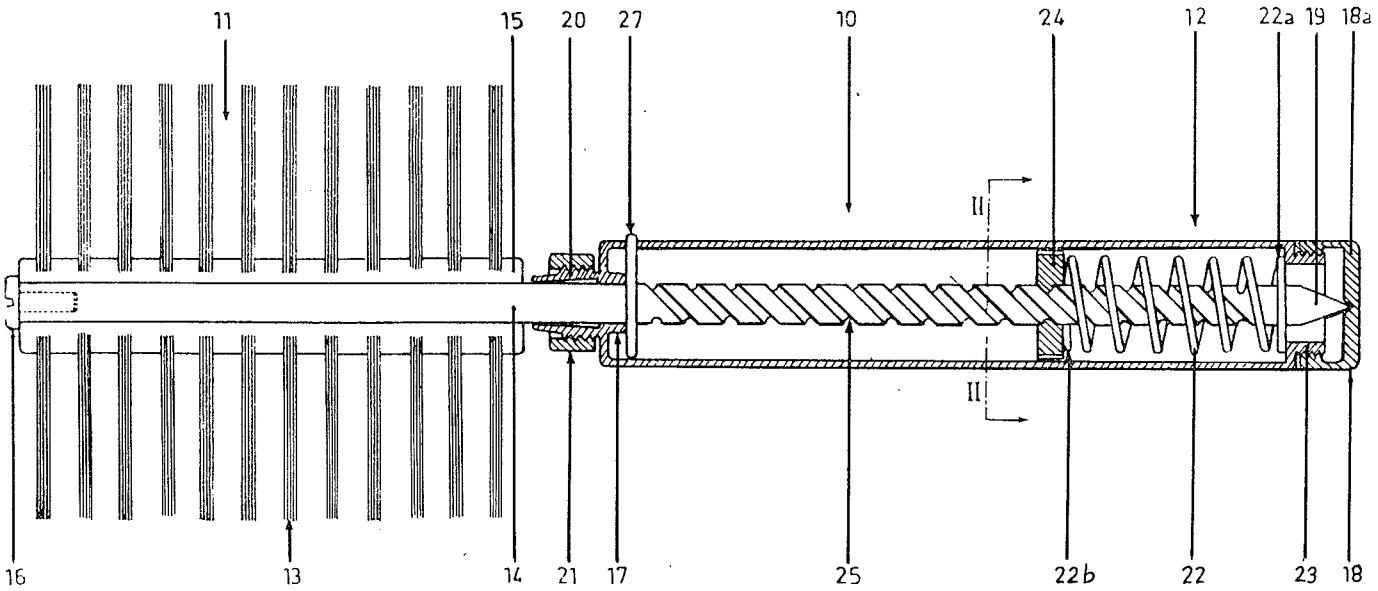
Figure 2:
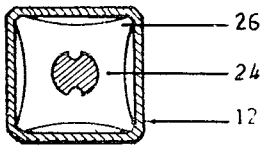
FIG. 2 is a cross-section taken along II—II in FIG. 1.
Figure 3:
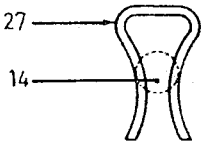
FIG. 3 is an elevation of the spring clip which maintains the brush axle in longitudinal position relative to the handle.

In the embodiment of FIGS. 1 to 3, the automatic brush is designated generally by reference numeral 10. This brush is composed of a brush head 11 and an operating handle 12. The brush head comprises a cylindrical brush 13, associated with a rotation axle 14. The hub 15 of the brush may be of one piece with axle 14, or alternatively removeable as in the form illustrated and attached to the axle by means of a screw 16. This mounting method makes it possible to use brushes of different diameters, depending on the specific work to be performed. Rotation axle 14 of the brush head is rotationally guided within handle 12, by means of bearing 17 and centering pivot 18, respectively. The later receives pointed extremity 19 of the brush axle. Bearing 17 has a ring shaped extension 20 which is radially deformable and which can be tightened or loosened with respect to the rotation axle 14 by means of a nut 21 which operates to tighten or loosen the ring. The locking means constituted by ring 20 and nut 21 permits either free rotation of axle 14 relative to handle 12, or rigid coupling of this handle to the axle in order to counteract the occurrence of automatic movements of the brush head.

An important element of the invention involves a spring 22 which is placed between control handle 12 and axle 14, and which accumulates tensional energy due to rotation of said axle when the brush is displaced by a manual pulling movement along a hank of hair. The spring releases its energy to that rotation axle when the manual pulling movement is discontinued. The direction of brush rotation then reverses to produce automatic rolling-up of the hank under tension around brush 13.

In the embodiment illustrated, spring 20 is a compression spring coaxial with respect to rotation axle 14. Spring 22 is supported at its end **22*a* on a shoulder 23 and at its end 22*b* on an internally threaded nut 24 mounted on the longer part of axle 14 between the ends of handle 12. Nut 24, as it is illustrated in FIG. 2, is rotationally fixed with respect to handle 12. To that end the nut and the handle have polygonal cross-sections and the hollow interior of handle 12 provides an axial guideway for nut 24.**

In accordance with a preferred embodiment, the hollow interior of the handle has a square cross-section and the nut has four concave faces so that the corners of the nut provide a short bearing 26 and slide on a corresponding bearing segment of the corner angles of the square cross-section of the handle interior. Because of this arrangement, spring 22 can be placed under tension by nut 24 when the brush is set into rotary motion; as soon as the rolling pulling movement of the brush over the hank is discontinued, the direction of rotation of the brush reverses, triggered by the force exerted by spring 22 on nut 24.

Axle 14 is axially immobilized within handle 12 by means of a spring clip 27 (see FIG. 3) which can be withdrawn from outside the handle in order to disassemble axle 14 from the handle.

Finally the bottom 18*a* of the handle is detachable from the body of the handle either by a tight sliding joint or by a screw joint.

It is understood that the brush could be constructed without driving spring and, while less practical, this embodiment is not beyond the scope of the invention.

Figure 4:
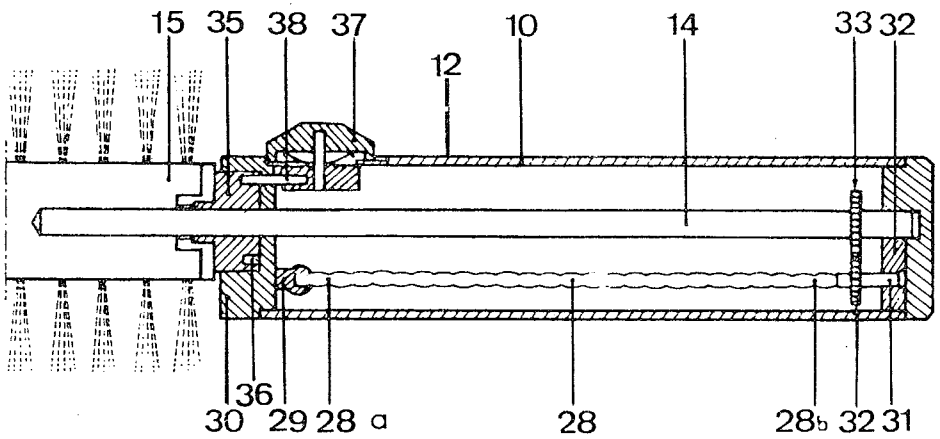
FIG. 4 is an axial section showing one embodiment of the automatic rolling mechanism of the brush.

In the embodiment of FIG. 4, the axle driving mechanism is constituted by a torsion spring 28. This spring takes the form of a torsion stem or bar, preferably made of elastic material. Torsion bar 28 extends parallel to axle 14 along most of its length within handle 12 of the brush. End 28*a* of the torsion bar is connected by means of an anchor pin 29 to a stationary wall 30 of the control handle. End 28*b* of torsion bar 28 is connected to the end of rotating axle 31 journaled within the stationary bottom 32 of the brush handle.

Axle 14 is firmly connected rotationally to torsion bar 28 and axle 31 by means of two pinions 32 and 33. It is not beyond the scope of the invention to provide other means of transmission between axle 14 and torsion bar 28. For example, both axle 14 and bar 28 may carry a pulley, the connection then being provided by means of a drive belt, e.g. a crenellated belt, or one with a high coefficient of friction to prevent slippage between axle 14 and torsion bar 28.

Figure 5:
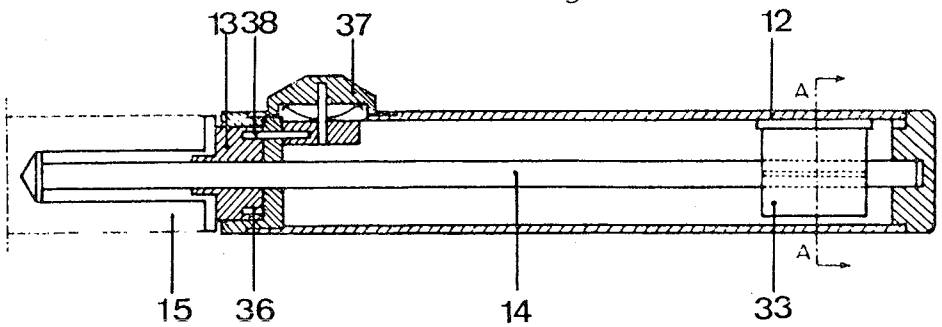
FIG. 5 shows another embodiment of this mechanism.
Figure 6:
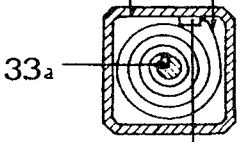
FIG. 6 is a cross-section taken along A—A in FIG. 5.

In the embodiment shown in FIGS. 5 and 6, the torsion spring is a spiral spring 33 whose inner end 33*a* is attached directly to the rotation axle 14 of the brush, whereas its outer end 33*b* is attached to the control handle 12 by anchor 34.

In the two embodiments illustrated, the disengageable coupling means between the brush body 15 and axle 14 consists of a sleeve 35 fixedly attached for rotation together with axle 14. The sleeve includes, on the side facing the interior of the handle, a series of recesses 36 distributed coaxially relative to axle 14, into which a latch pin 38 can be pushed under the influence of control knob 37. With the pin in a recess, rotation of the brush-carrying axle is precluded, handle 12 and the brush being then fixed relative to each other. In the other axial position of knob 37, namely the unlatched one, latch pin 38 leaves the recess 36 of the sleeve in which it had been engaged. This permits free rotation of said sleeve relative to handle 12 and therefore also rotation of the brush and its axle against only the resistance of the torsion spring.

The brush in its various embodiments described and illustrated can easily be adapted to a heater-blower such as a hair dryer.

I claim:

1. A hair styling brush comprising: an operating handle, a brush head in the form of a cylindrical body of revolution; a rotation axle attached to said head and supported for rotation inside said handle in such manner that said head starts to rotate when it contacts and is manually pulled along a hank of hair; and spring means interposed between handle and axle, said spring accumulating tensional energy due to said rotation so as to produce reverse rotation of the brush head upon release, thereby to produce automatic rolling-up on the brush of the hank under tension.

2. A brush according to claim 1 characterized in that said handle is hollow and has a polygonal internal cross-section, and comprising further a pushing means of matching form guided within said handle and rotationally fixed to be displaced axially along a helical ramp provided on the rotation axle of the brush, said pushing means being subjected on one transverse face to the elastic force of a compression spring bearing upon an internal projection within the operating handle.

3. A brush according to claim 1 further comprising means for guiding said rotation axle for the brush head, said guiding means including a bearing within the handle near the end closest to the brush head, and a centering pivot at the bottom of the handle for receiving the pointed end of said axle.

4. A brush according to claim 1 further comprising rigid coupling means for rotationally immobilizing the rotation axle for the brush head relative to the handle between handle and axle.

5. A brush according to claim 4 characterized in that the rigid coupling means is a ring radially deformable by a tightening nut.

6. A brush according to claim 4 characterized in that the rigid coupling means between the handle of the brush and its rotation axle is disengageable and includes a sleeve fixed for rotation together with the axle and a controllable latch mounted on the handle so that in one axial position of the latch the sleeve is fixed relative to the control handle and in another axial position of the latch the axle and sleeve can turn freely relative to the handle.

7. A brush according to claim 1 characterized in that the brush head is detachable from the rotation axle.

8. A brush according to claim 1 characterized in that the spring means includes a torsion spring which, after being placed under tension, transmits a rotational couple to the brush axle.

9. A brush according to claim 8 characterized in that the torsion spring takes the form of a bar extending parallel to the rotation axle of the brush along the greater length of its portion inside the handle, and comprising means for driving said bar and axle rotationally together, said driving means including two coupling pinions.

10. A brush according to claim 8, characterized in that the driving means coupling the brush axle and the torsion bar consists of an endless transmission including pulleys and a connecting drive belt.

11. A brush according to claim 8, characterized in that the torsion spring is a spiral spring whose inner end is attached to the rotation axle of the brush and whose outer end is attached to the control handle.

* * * * *